US011519702B1

(12) United States Patent
Routhier et al.

(10) Patent No.: US 11,519,702 B1
(45) Date of Patent: Dec. 6, 2022

(54) CARTRIDGE AND CARTRIDGE CASE

(71) Applicant: General Dynamics Ordnance and Tactical Systems—Canada Inc., Repentigny (CA)

(72) Inventors: Yann Routhier, Repentigny (CA); Jean-Sébastien Saudrais, Repentigny (CA); Jean Paradis, Repentigny (CA)

(73) Assignee: General Dynamics Ordnance and Tactical Systems -Canada Inc., Repentigny (CA)

( * ) Notice: Subject to any disclaimer, the term of this patent is extended or adjusted under 35 U.S.C. 154(b) by 0 days.

(21) Appl. No.: 17/457,049

(22) Filed: Dec. 1, 2021

(51) Int. Cl.
*F42B 5/285* (2006.01)

(52) U.S. Cl.
CPC ..... *F42B 5/285* (2013.01)

(58) Field of Classification Search
CPC ..... F42B 5/285; F42B 5/307; F42B 5/313; F42B 5/26; F42B 5/28
USPC ..... 102/439, 464–469
See application file for complete search history.

(56) References Cited

U.S. PATENT DOCUMENTS

| | | | | |
|---|---|---|---|---|
| 345,165 | A * | 7/1886 | Stadler et al. | F42B 5/26 102/469 |
| 1,034,684 | A | 8/1912 | Brown | |
| 3,292,541 | A | 12/1966 | Stadler et al. | |
| 4,598,445 | A | 7/1986 | O'Connor | |
| 4,738,202 | A | 4/1988 | Hebert | |
| 4,972,777 | A | 11/1990 | Algera | |
| 5,033,386 | A | 7/1991 | Vatsvog | |
| 5,233,928 | A | 8/1993 | Ducros et al. | |
| 5,259,288 | A | 11/1993 | Vatsvog | |
| 7,059,234 | B2 | 6/2006 | Husseini | |
| 7,204,191 | B2 | 4/2007 | Wiley et al. | |
| 9,182,204 | B2 | 11/2015 | Maljkovic et al. | |
| 9,506,735 | B1 | 11/2016 | Burrow | |
| 9,599,443 | B2 | 3/2017 | Padgett et al. | |
| D813,975 | S | 3/2018 | White | |
| 9,939,236 | B2 | 4/2018 | Drobockyi et al. | |
| D836,180 | S | 12/2018 | Burrow | |
| D861,119 | S | 9/2019 | Burrow | |
| 10,866,072 | B2 | 12/2020 | Imhoff et al. | |

(Continued)

FOREIGN PATENT DOCUMENTS

| | | | |
|---|---|---|---|
| DE | 2705235 | A1 | 8/1978 |
| DE | 8407385 | U1 | 11/1984 |

(Continued)

*Primary Examiner* — Reginald S Tillman, Jr.
(74) *Attorney, Agent, or Firm* — LKGlobal | Lorenz & Kopf, LLP

(57) ABSTRACT

A cartridge includes a cartridge case having a shell having a first end portion, a second end portion opposite the first end portion and a cylindrical body extending from the first end portion to the second end portion. A reinforcing cap includes a base, a sidewall extending from the base and surrounding the first end portion such that the first edge of the shell abuts an inner face of the base, and a projection extending from the inner face. A ring is pressed against the inner face and forms an air-tight seal between the projection, the inner face, the ring, and the first end portion of the shell. A plurality of indentations form protrusions in the sidewall and the first end portion for interlocking the reinforcing cap to the shell and retaining the ring against the inner face of the base.

25 Claims, 4 Drawing Sheets

(56) References Cited

U.S. PATENT DOCUMENTS

| | | | |
|---|---|---|---|
| 2005/0005807 | A1 | 1/2005 | Wiley et al. |
| 2005/0188879 | A1 | 9/2005 | Wiley et al. |
| 2007/0214992 | A1 | 9/2007 | Dittrich |
| 2015/0033970 | A1 | 2/2015 | Maljkovic et al. |
| 2016/0131463 | A1 | 5/2016 | Stauffer |
| 2018/0292186 | A1 | 10/2018 | Padgett et al. |
| 2019/0226817 | A1 | 7/2019 | Imhoff et al. |
| 2020/0158480 | A1 | 5/2020 | Routhier et al. |
| 2020/0182594 | A1 | 6/2020 | Imhoff et al. |

FOREIGN PATENT DOCUMENTS

| | | | | |
|---|---|---|---|---|
| EP | 3049752 | B1 | 2/2019 | |
| FR | 2264267 | A1 * | 3/1974 | ..... F42B 7/06 |
| FR | 2544068 | A1 | 10/1984 | |
| WO | 9513516 | A1 | 5/1995 | |
| WO | 2008091245 | A2 | 7/2008 | |

* cited by examiner

CARTRIDGE AND CARTRIDGE CASE

TECHNICAL FIELD

The technical field relates generally to cartridge cases and cartridges for weapon systems, and more particularly, relates to relatively lightweight cartridge cases including a shell mechanically coupled to a reinforcing cap using a plurality of indentations forming protrusion therebetween.

BACKGROUND

Cartridges include a cartridge case that contains other major components of the cartridge used in weapon systems, including a propellant, a projectile or bullet, and a primer. Prior art small caliber cartridge cases can be divided into 3 groups; brass cartridge cases, other metallic cartridge cases that are lighter weight than brass cartridge cases, and polymer lightweight cartridge cases.

Conventional cartridge cases made of brass are typically deep drawn, resulting in good mechanical properties, but are relatively heavy. For example, typical conventional cartridge cases used by military forces and/or commercial users are often made from C26000 brass or other similar alloys, which is relatively heavy, since brass has a density of around 8.53 g/cc. Furthermore, brass, containing about 70% copper and 30% zinc, is subject to frequent, rapid commodity market price fluctuations and is considered one of the costlier common use metals in ammunition products.

Lightweight cartridge cases have been of interest for many years, for example, to lessen the load on soldiers and/or to increase their ammo carrying capacity for a given weight to be carried into battle. A reduced load translates into less soldier fatigue and better mobility for the soldier, while more ammunition being carried into battle on the other hand increases the odds of successful combat engagements by allowing for more, heavy ammo-consuming strategies.

Prior art lightweight cartridge cases have been produced using various manufacturing processes but present various trade-offs when compared to conventional brass cartridge cases. For example, some of the more significant trade-offs are a reduced internal cartridge case volume and/or significant initial capital investment to industrialize a new manufacturing process.

Prior art lightweight cartridge cases made of polymers or combinations of polymers and metals may have varying levels of functional mechanical resistance. These varying levels depend on the weapon system used to fire the cartridge including all of the mechanical interactions that occur between the cartridge and the feeding, firing and extracting components in those weapon systems.

Typically, polymer cartridge cases require a thicker wall to compensate for reduced mechanical strength properties compared to conventional brass cartridge cases. This means a smaller inside diameter at the case body section is available for polymer cartridge cases. A reduced internal case volume is of concern for end users of polymer lightweight cartridge cases due to the performance specification requirements of each small caliber cartridge. Reduced internal case volume translates to less propellant capacity and therefore, reduced muzzle velocity, resulting in less kinetic energy in the projectile at any distance after firing.

Additionally, once a cartridge case is adopted by the military or even commercial markets, enormous quantities need to be manufactured to keep up with the demand. This makes the cartridge case manufacturing process critical to its viability for sustained use over time. Without adequate high-capacity and accurate manufacturing equipment and processes, production costs and quality levels cannot be maintained at a point where it is favorable to switch to polymer cartridge cases. Presently, polymer cartridge cases cannot be produced as quickly or as reliably as their conventional brass counterparts. New, state of the art, controlled polymer injection molding machines may replace currently existing brass cartridge case manufacturing equipment on a 1:1 ratio but still only generate a fraction of the required production output necessary to sustain the world military and commercial demand. Currently, there is no polymer cartridge case manufacturing machinery capable of delivering the same production output provided by production equipment for conventional brass cartridge cases for the same shop floor space.

Because the military is unlikely to be reducing its ammunition consumption in the foreseeable future, more floor space would need to be dedicated to polymer cartridge case manufacturing. This means that much larger buildings would be required to house the additional required machines, which represents a considerable initial capital investment. Furthermore, the overhead costs associated with these buildings would also be higher than current, smaller buildings used for manufacturing brass cartridge cases, as well as higher costs for heating, security, maintenance, and other related recurring costs.

Moreover, polymers are typically much weaker than metals and therefore, using polymers to form lightweight cartridge cases would normally require a thickening of the wall section along the length of a cartridge case to resist the forces imparted onto the cartridge case during weapon firing. This translates into a reduced cartridge internal volume, thus imposing a reduced maximum propellant charge weight that can be loaded into the cartridge case. In turn, this reduces the maximum velocity at which a projectile leaves a weapon system, resulting in reduced kinetic energy delivery to the target.

Another consequence of polymers typically being weaker than metals is that polymer lightweight cartridge cases can have a reduced safe maximum operating pressure due to the lower cartridge case mouth mechanical resistance. Along the shoulder and body of the cartridge case, the wall can be thickened to compensate for this weakness, trading off internal volume capacity for the propellant powder. However, because a conventional weapon chamber and corresponding projectile each have a fixed geometry, as determined by industry standards such as CIP (Commission Internationale Permanente Pour l'Épreuve Des Armes A Feu Portatives) and SAAMI (Sporting Arms and Ammunition Manufacturers' Institute), a physical constraint restricts the thickness of additional polymer material that can be used to achieve the desired mechanical resistance at the cartridge case mouth wall. This often translates into split cases around the case mouth area. To solve this problem, existing weapon systems would need to have their chambers reamed out to allow for increased polymer cartridge case thickness around the weaker case mouth areas.

Yet another consequence of polymers typically being weaker than metals is that polymer lightweight cartridge cases can have a reduced retention of the primer within the cartridge case primer pocket. Polymers normally do not offer enough press-fit mechanical resistance to suit this type of assembly without the use of an additional bonding agent.

Further, gluing projectiles to the cartridge case mouth of polymer lightweight cartridge cases to meet the CIP, SAAMI or military specification mandatory bullet extraction force requirements, such as the NATO (North Atlantic Treaty Organization) STANAG (STANdardization Agreement), is another concern with this sub-category of cartridge case designs. Without some sort of bonding agent, polymers do not offer enough spring back force on their own as compared to metals to adequately hold a projectile in the case mouth using standard mechanical assembly methods. Projectiles held too lightly by the case mouth normally exhibit more variable bullet extraction forces and thus, tend to increase the projectiles' standard deviation with respect to muzzle velocity, which then negatively affects accuracy and dispersion on the target.

Additionally, heat removal from the weapon chamber is also a concern with polymer lightweight cartridge cases. A brass or steel cartridge case effectively functions as a thermal sink in conventional weapon systems. When firing, heat generated from the burning gases gets absorbed by a highly conductive brass or steel cartridge case and the heat gets expelled out of the weapon with the brass or steel case during the post-firing extraction cycle. Since a polymer cartridge case does not conduct heat very well, the polymer case will not absorb the heat as efficiently as a brass or steel cartridge case and therefore, does not remove heat as effectively upon being ejected from the weapon system. This, in turn, causes the weapon system to heat up quicker and imposes a more controlled and shorter firing sequence in order to not overheat the weapon system components.

Once heated, polymers tend to rapidly lose their mechanical properties. This can be problematic when a weapon has been heated due to sustained firing and a polymer cartridge is then left for a time within the cartridge chamber. Unlike metals, there is also some uncertainty regarding creep resistance of polymer cartridge cases. Most conventional machinegun cartridges are assembled with metallic links that allow for high rates of feeding and firing. These links are typically made of spring steel and the cartridge is basically captured by the link in a press-fit condition. Linked cartridges can be stored for many years before being used. Once linked, cartridges are subject to a constant pressure along the surface area where the link holds the cartridge. Since the polymer cartridge case is much softer than the metallic link, the cartridge case may bulge or creep over time, causing the cartridge case to become permanently deformed, resulting in irregular diameters directly above and below the upper and lower edges of the link where the link is in contact with the cartridge case. In some instances, this creeping effect over time can result in cartridge case stress-induced failures upon firing.

Lastly, little is known about long-term storage behavior under various environmental conditions for polymer cartridge cases. For example, certain types of polymers may be susceptible to UV radiation, which could become an issue if cartridges with polymer cartridge cases were to be left outside exposed to the UV radiation for prolonged periods of time. Further, solvent exposure is also of concern because some solvents are incompatible with certain grades of polymers and can completely dissolve the polymer. For example, if cartridges with polymer cartridge cases are left in the proximity of an open fuel tank, there could be possible interactions between the polymer cartridge case and the fuel or fuel vapors from the fuel tank.

Prior art lightweight metallic cartridge cases can be divided into two main categories. The first category includes a shell with an interior reinforcement and a second category includes a shell with an exterior reinforcement.

Lightweight metallic cartridge cases with an interior reinforcement may use lightweight aluminum for the interior reinforcement component. However, doing so may result in instances of aluminothermic reaction whereby the aluminum combusts when exposed to high temperatures and gas pressures above 40,000 PSI, which are typical conditions experienced during cartridge firing. The combusting aluminum can then no longer hold back the gas pressure and can split completely though the interior reinforcement, transferring the pressure to the outer shell which then stretches to failure.

Furthermore, obtaining a perfect gas seal between the outer shell and its interior reinforcement has proven to be unreliable. It is interesting to note that both the flash hole junction as well as the reinforcement junction are both equally susceptible to improper sealing. The slightest geometric defect in either component can result in an inadequate seal that can then cause a cartridge to swell, inducing extraction issues, or to completely fail upon firing.

Because the outer shells of lightweight metallic cartridge cases are stamped and formed using a set of dies and punches, rounded edges all around the cartridge case extraction groove may result at every bend in the metal. This makes extracting the fired cartridge cases more difficult because the weapon extractor cannot grab the cartridge case as firmly and "slips" on the rounder case base edges.

Lightweight metallic cartridge cases with an exterior reinforcement often have assembly strength issues. Prior art designs, for example as disclosed in U.S. Pat. No. 9,939,236 B2, use a small diameter hollow rivet through the cartridge case flash hole to hold both halves together. However, doing so severely limits the sectional area available to handle the stresses imposed on the cartridge case extraction post firing. This is because, during the extraction cycle, the firing pressure gases are not fully vented out when the weapon system starts to apply an extraction force on the cartridge case. This force increases until the cartridge case becomes free from the chamber but may induce separation of the two parts, and thus, a failure can occur before case extraction is complete. This greatly limits the viability for the use of this type of cartridge case in machine guns which experience high extraction forces.

Accordingly, it is desirable to provide relatively lightweight cartridge cases that address one or more of the foregoing concerns, and cartridges including such cartridge cases. Furthermore, other desirable features and characteristics of the various embodiments described herein will become apparent from the subsequent detailed description and the appended claims, taken in conjunction with the accompanying drawings and this background.

SUMMARY

Cartridge cases and cartridges adapted to be chambered in a weapon system are provided herein. In an exemplary embodiment, a cartridge case for chambering in a weapon system. The cartridge case includes a shell configured to contain a propellant in an internal volume thereof. The shell has a first end portion terminating at a first edge, a second end portion opposite the first end portion that is configured to receive a projectile and a cylindrical body extending from the first end portion to the second end portion. A reinforcing cap is disposed over the first end portion of the shell. The reinforcing cap has a base, a sidewall extending from the base and surrounding an outer surface of the first end portion such that the first edge of the shell abuts an inner face of the base. A projection extends from the inner face into the internal volume. A primer pocket formed in an outer face of the base. A bore extends from the primer pocket through the projection into the internal volume. A ring is pressed against the inner face of the base such that an inner sidewall of the ring sealably engages an outer surface of the projection and an outer sidewall of the ring sealably engages an inner surface of the first end portion. An air-tight seal is formed between the projection, the inner face, the ring, the first end portion of the shell. A plurality of indentations are formed in the sidewall of the reinforcing cap around the sidewall of the reinforcing cap. Each of the indentation form a protrusion in the inner face of the base and the first end portion of the shell for interlocking the reinforcing cap to the shell and retaining the ring against the inner face of the base.

In another exemplary embodiment, a cartridge for chambering in a weapon system. The cartridge includes a shell containing a propellant in an internal volume thereof. The shell has a first end portion terminating at a first edge, a second end portion opposite the first end portion receiving a projectile and a cylindrical body extending between the first end portion and the second end portion. The propellant is ignitable to generate a combustion gas for propelling the projectile from the shell. A reinforcing cap is disposed over the first end portion of the shell. The reinforcing cap has a base and a sidewall extending from the base and surrounding an outer surface of the first end portion such that the first edge of the shell abuts an inner face of the base. A projection extends from the inner face into the internal volume. A primer pocket is formed in an outer face of the base. A bore extends from the primer pocket through the projection into the internal volume. A primer is disposed in the primer pocket and is operable to ignite the propellant through the bore. A ring is pressed against the inner face of the base such that an inner sidewall of the ring sealably engages an outer surface of the projection and an outer sidewall of the ring sealably engages an inner surface of the first end portion. An air-tight seal is formed between the projection, the inner face, the ring, the first end portion of the shell. A plurality of indentations are formed in the sidewall of the reinforcing cap around the sidewall of the reinforcing cap. Each of the indentation form a protrusion in the inner face of the base and the first end portion of the shell for interlocking the reinforcing cap to the shell and retaining the ring against the inner face of the base.

BRIEF DESCRIPTION OF THE DRAWINGS

The various embodiments will hereinafter be described in conjunction with the following drawing figures, wherein like numerals denote like elements, and wherein.

DETAILED DESCRIPTION

Figure 1:
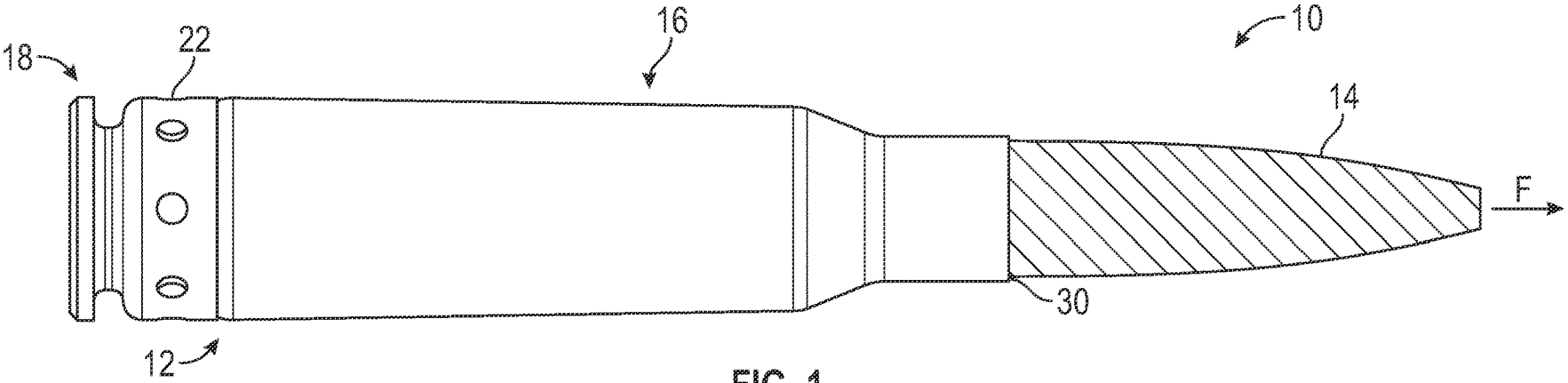
FIG. 1 is a side illustrating a cartridge in accordance with an exemplary embodiment.

The following detailed description is merely exemplary in nature and is not intended to limit the various embodiments or the application and uses thereof. Furthermore, there is no intention to be bound by any theory presented in the preceding background or the following detailed description.

Various embodiments contemplated herein relate to relatively lightweight cartridges and cases compared to conventional brass cartridges and cases. The exemplary embodiments taught herein provide a cartridge case for a cartridge adapted to be chambered in a weapon system. The cartridge case includes a shell configured to contain a propellant in an internal volume thereof. The shell has a first end portion terminating at a first edge, a second end portion opposite the first end portion that is configured to receive a projectile and a cylindrical body extending from the first end portion to the second end portion. A reinforcing cap is disposed over the first end portion of the shell. The reinforcing cap has a base, a sidewall extending from the base and surrounding an outer surface of the first end portion such that the first edge of the shell abuts an inner face of the base. A projection extends from the inner face into the internal volume. A primer pocket formed in an outer face of the base. A bore extends from the primer pocket through the projection into the internal volume. A ring is pressed against the inner face of the base such that an inner sidewall of the ring sealably engages an outer surface of the projection and an outer sidewall of the ring sealably engages an inner surface of the first end portion. An air-tight seal is formed between the projection, the inner face, the ring, the first end portion of the shell. A plurality of indentations are formed in the sidewall of the reinforcing cap around the sidewall of the reinforcing cap. Each of the indentation form a protrusion in the inner face of the base and the first end portion of the shell for interlocking the reinforcing cap to the shell and retaining the ring against the inner face of the base.

In an exemplary embodiment, the shell includes a first metallic material and the reinforcing cap includes a second, relatively lightweight metallic material that is different than the first metallic material. Advantageously, in an exemplary embodiment, this novel, bi-metallic, multi-part cartridge case includes the reinforcing cap locked onto a relatively thin-wall shell allows for a redistribution of mass to reinforce critical, stress supporting areas of the cartridge case as compared to conventional lightweight cartridge cases.

Another additional advantage of the cartridge case disclosed herein is that, in some embodiments, a significant weight reduction of the cartridge case is achieved. Additionally, as such, the cartridge including the cartridge case having a significant weight reduction while maintaining all appreciable features of the conventional brass design.

In an exemplary embodiment, the cartridge case includes the metallic reinforcing cap and the metallic shell that has a relatively constant wall thickness through its entire length. Further, the front shell is dimensioned to fit properly into typical, existing small arms weapon system chambers and properly seals the chambers upon firing the cartridge. In an exemplary embodiment, the reinforcing cap is dimensioned to ensure that conventional weapon extractor systems can reliably grab and extract the spent cartridge case after firing. Further, the reinforcing cap is designed to prevent case failures at peak pressure and temperature during the firing cycle by effectively supporting the aft end of the steel case body of the shell of the cartridge case. In an exemplary embodiment, both the shell and the reinforcing cap are effectively joined together by means of staking a plurality of indentation into the shell and the reinforcing cap.

An additional advantage of the cartridge case disclosed herein is that, in some embodiments, an overall weight of the cartridge case is reduced by roughly 50% while the internal volume available to receive the propellant powder charge is increased by about 8% as compared to conventional brass cartridge cases. Further, the cartridge including such cartridge case has an overall weight reduction of at least 10% as compared to cartridges that include conventional brass cartridge cases.

An additional advantage of the cartridge case disclosed herein is that, in some embodiments, the cartridge case maximizes internal case volume by introducing a constant wall thickness shell supported by the attached reinforcing cap. Being deep drawn, conventional brass cartridge cases do not have a constant wall thickness. The typical brass case is thinnest at the mouth and shoulder region and becomes progressively thicker as it nears its base. This is a consequence of the progressive deep drawing manufacturing process itself and cannot be remedied. In order to produce a full, solid case base using brass, wall thickness must smoothly increase from the thin neck area to the thick base area. As such, the internal case volume of brass cartridge cases is less than the internal case volume of the cartridge case disclosed herein.

An additional advantage of the cartridge case disclosed herein is that, in some embodiments, a stronger mechanical interlock is formed between the front shell and the reinforcing cap via the plurality of indentation. As will be discussed in further detail below, by designing and exploiting a unique dimple feature near the base of the shell which securely mates the shell to the reinforcing cap, an air-tight seal which is significantly increased stress supporting area is created. As such, the cartridge case is enhanced to withstand the weapon extraction forces that a cartridge case will be subjected to in a weapon system. In an exemplary embodiment, there is no longer any need to pass through the relatively small cartridge case flash hole to create the locking feature between the components as with some prior art cartridge case designs.

Another additional advantage of the cartridge case disclosed herein is that, in some embodiments, cartridge case splits are eliminated. In particular, prior art polymer cartridge cases are severely limited in respect to possible dimensional changes in the case mouth area because of the geometrical and physical limitations imposed by current industrial and military standards regarding the weapon chamber and the projectile dimensions. The exterior form of the cartridge case and the corresponding bullet are precisely defined to ensure commonality and interchangeability between the various cartridges and weapons (for a given caliber) produced by the plethora of manufacturers around the world. Polymers, typically being mechanically weaker than metals, would nominally require a thicker case mouth wall section to sustain the high pressures and stresses involved in firing a cartridge. However, the previously mentioned physical dimensional limitations preclude significantly increasing the case mouth wall thickness and may result in a weak section that fails on the polymer type of cartridge case when used in current small arms weapons. The cartridge cases disclosed herein solve this problem by using high-strength stainless steel in this area. This allows for an equivalent case mouth mechanical strength when compared to conventional brass casings.

An additional advantage of the cartridge case disclosed herein, in that in some embodiments, the cartridge case does not experience any material creep when linked. In particular, prior art polymer cartridges which have undergone material creep after being linked can be problematic and induce failures when going through a fully automatic machine gun firing cycle. For example, localized "bulging" of a polymer case, at sections directly adjacent to the metallic link edges may occur and generate irregular case exterior diameters, which may in turn reduce performance reliability. The material creeping phenomenon is the result of the constant pressure applied by a metallic link's press-fit on a softer polymer cartridge case where the link firmly grabs the case. Polymer cartridge cases have been known to be more susceptible to material creep or flow when stressed by the metallic links after being stored for extended periods of time. The cartridge cases disclosed herein are creep-resistant, for example similar to the creep resistance of conventional brass cartridge cases.

Another additional advantage of the cartridge case disclosed herein, is that in some embodiments, the cartridge case is resistant to long-term ultraviolet (UV) light exposure. In particular, stainless steel, for example, which may form the shell and the reinforcing cap, respectively, are impervious to UV radiation and as such, their mechanical properties are not affected by long-term exposure to UV radiation. This is however not the case with many polymeric materials, which may experience material strength degradation as a result of long-term exposure to UV radiation. An additional advantage of the cartridge case disclosed herein, is that in some embodiments, the cartridge case is corrosion free. In particular, stainless steel, for example, which may form the shell and the reinforcing cap is a corrosion-resistant metal.

Another additional advantage of the cartridge case disclosed herein, is that in some embodiments, the cartridge case is compatible with high capacity cartridge loading and packaging equipment. In particular, an important factor in the design of a new ammunition is its successful viability industrialization potential within existing industrial manufacturing facilities, thus obviating the requirement for new, specialized production equipment. The cartridge cases disclosed herein can be efficiently and effectively manufactured on current, existing high-capacity loading and packing production equipment that is typically used in ammunition manufacturing plants today. Production cadences for the cartridge cases disclosed herein are expected to be similar to those of cartridges made with conventional brass cartridge cases. This is however not the case with the more sensitive and complex polymer cartridge case designs.

An additional advantage of the cartridge case disclosed herein, is that in some embodiments, the cartridge cases can be efficiently manufactured at a competitive cost. In particular, being able to load the cartridge cases disclosed herein on existing production equipment means only a minimal tooling investment is required to get up to and achieve typical brass cartridge case level production rates. The production cadences for the cartridge cases disclosed herein are similar to those with brass cartridge cases while steel and aluminum base materials are less expensive than brass. As such, price-wise, the cartridge cases disclosed herein are competitive with brass cartridge cases once fully industrialized. By contrast, polymer cartridge cases, even when fully industrialized, will still remain much more expensive due to their special manufacturing process requirements and resulting lower production cadence.

Figure 2:
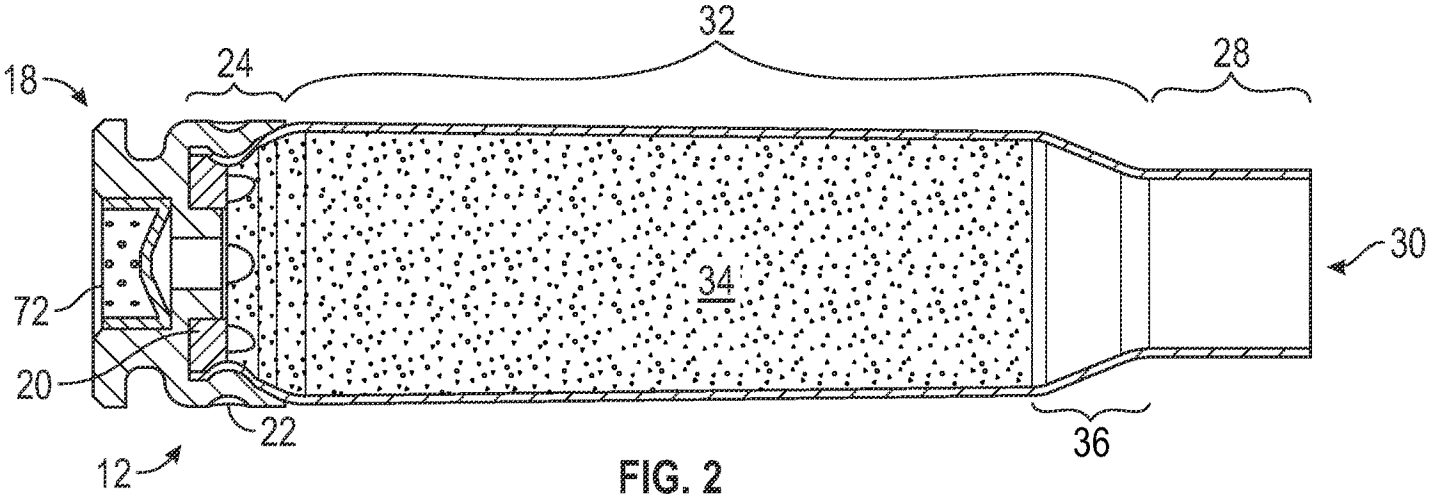
FIG. 2 is a side cross-sectional view illustrating the cartridge case in accordance with an exemplary embodiment.

With reference now to the drawings, FIG. 1 is a side view illustrating a cartridge 10 including a cartridge case 12 and a projectile 14 that is adapted to be chambered in a weapon system in accordance with an exemplary embodiment. FIG. 2 is a side cross-sectional view illustrating the cartridge case 12 depicted in FIG. 1. The cartridge case 12 includes a generally cylindrical shell 16 and a reinforcing cap 18 that is interlocked with the shell 16 and an annular seal in the form of a ring 20 disposed between the shell 16 and the reinforcing cap 18. A plurality of indentations 22 are formed in the shell 16 and the reinforcing cap 18 to interlock the reinforcing cap 18 to the shell 16 and retain the ring 20 against the reinforcing cap 18.

The shell 16 includes a first end portion 24 terminating at a first edge 26, a second end portion 28 opposite the first end portion 24 that is configured to receive the projectile 14 in a shell mouth 30 and a cylindrical body 32 extending between the first end portion 24 and the second end portion 28. The shell 16 surrounds an internal volume 34 which contains a propellant (shown as granules within the internal volume 34 in FIG. 2) within the shell 16. Optionally, a shoulder portion 36 may be formed in the cylindrical body 32 tapering inwardly to the second end portion 28 such that the shell mouth 30 has a substantially smaller diameter compared to the cylindrical body 32. Alternatively, the cartridge case 12 may not have a shoulder portion and, as such, the cylindrical body 32 extends straight forward and terminates at the shell mouth 30 without tapering inwardly such that the shell mouth 30 has a substantially similar diameter to the cylindrical body 32.

The reinforcing cap 18 is disposed over the first end portion 24 of the shell 16. The reinforcing cap 18 includes a base 38, a sidewall 40 extending from the base 38 and surrounding an outer surface 42 of the first end portion 24 such that the first edge 26 of the shell 16 abuts an inner face 44 of the base 38. A cylindrical projection 46 extends axially from the inner face 44 into the internal volume 34 of the shell 16. A primer pocket 48 is formed in an outer face 50 of the base 38. A through bore 52 extends from the primer pocket 48 through the cylindrical projection 46 into the internal volume 34.

Figure 3:
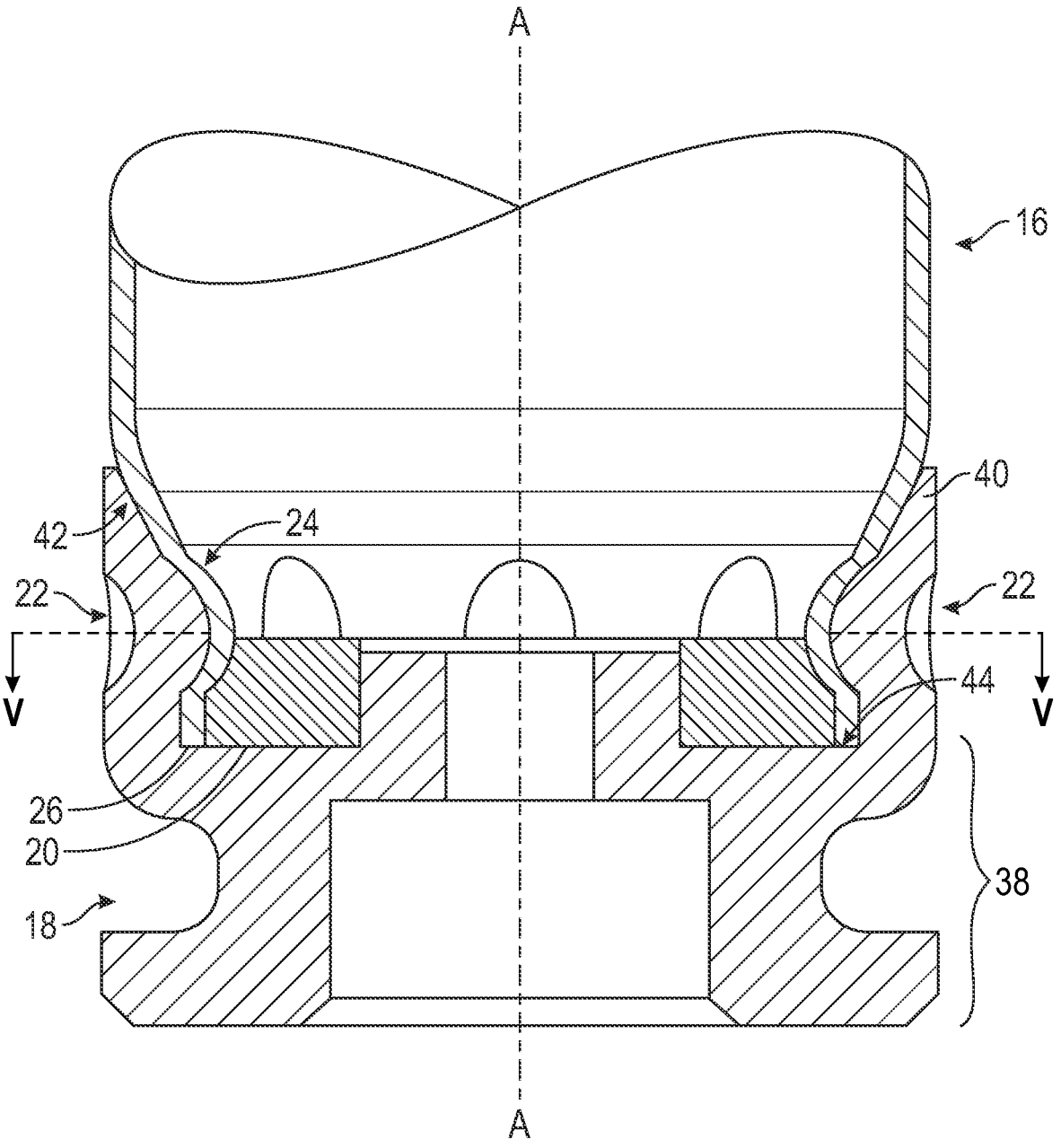
FIG. 3 is a partial side cross-sectional view illustrating a portion of the cartridge case in accordance with an exemplary embodiment.
Figure 4:
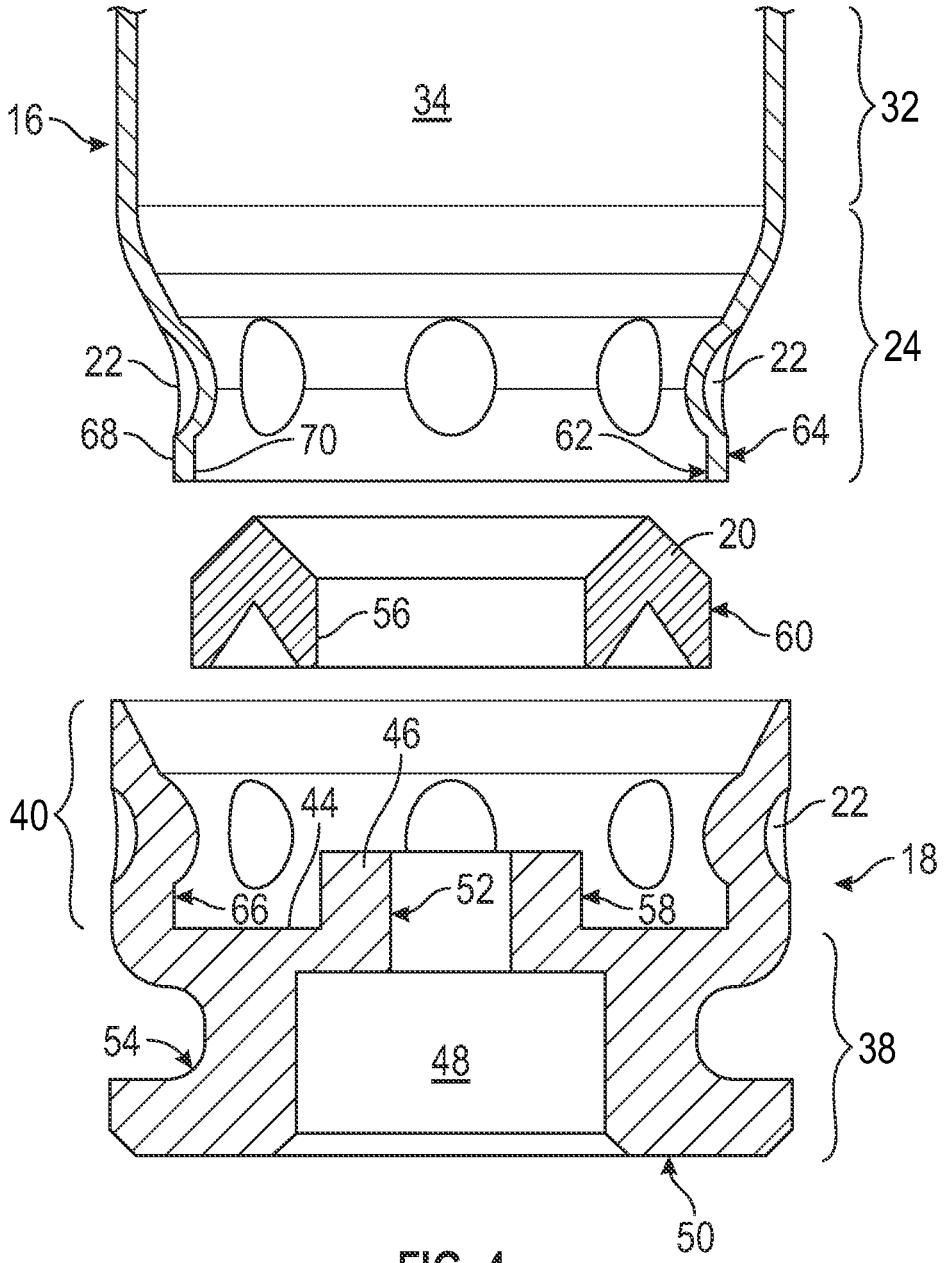
FIG. 4 is an expanded detail showing the individual components of the cartridge case.

The ring 20 is pressed against the inner face 44 of the base 38 such that an inner sidewall 56 of the ring 20 sealably engages an outer surface 58 of the cylindrical projection 46 and an outer sidewall 60 of the ring 20 sealably engages an inner surface 62 of the first end portion 24. The ring 20 is dimensioned to be readily disposed over the cylindrical projection 46 and has an inverted V cross-section (see FIG. 4) prior to being pressed against the inner face 44. As the ring 20 is pressed against the inner face 44, the apex of the ring 20 is deformed downwardly to fill the V-shaped notch causing the medial portion of the ring 20 to deform radially inwardly against the outer surface 58 of the cylindrical projection 46 and the lateral portion of the ring 20 to deform radially outwardly against the inner surface 62 of the first end portion 24 (compare FIG. 4 with FIGS. 2 & 3). An air-tight seal is formed between the outer surface 58 of the cylindrical projection 46, the ring 20, and the inner surface 62 of the first end portion 24 of the shell 16 to prevent combustion gases from leaking between the shell 16 and the reinforcing cap 18. For the configuration described herein, the air-tight seal is controlled and only required between two mating surfaces, namely the interface between inner sidewall 56 and outer surface 58 and the interface between outer sidewall 60 and inner surface 62.

The plurality of indentations 22 are formed by a staking process which locally deforms the sidewall 40 of the reinforcing cap 18 and the first end portion 24 of the shell 16. Each of the indentation 22 forms a discrete protrusion for interlocking the reinforcing cap 18 to the shell 16 and retaining the ring 20 against the inner face 44 of the base 38. In an embodiment, the discrete protrusions may be dimples having a partial spherical configuration, for example a truncated hemispherical volume or a spherical cap. Alternately, the discrete protrusions may be dimples having a U-shaped or V-shaped configuration. The discrete protrusions may be evenly spaced around a perimeter of the cartridge case 12.

Figure 5:
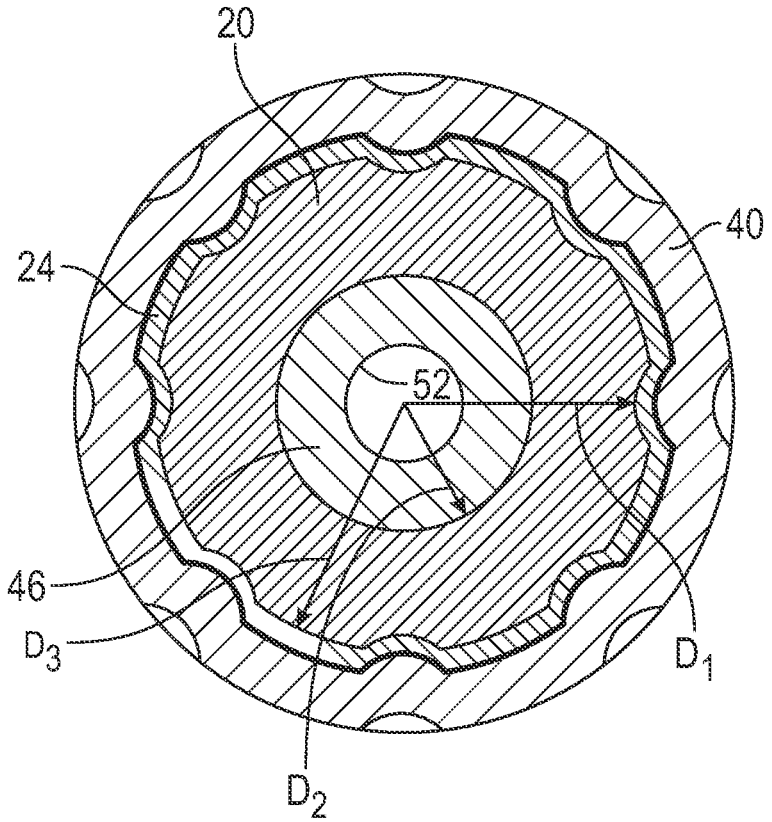
FIG. 5 is a cross section taken through V-V as shown in FIG. 3.

As shown in FIG. 5, a cross section V-V (see FIG. 3) in a plane parallel to the inner face 44 of the base 38 going through the plurality of indentations 22 defines a non-circular boundary between the shell 16 and the reinforcing cap 18. The shell 16 has a first linear boundary 64 between an inner surface 66 of the sidewall 40 of the reinforcing cap 18 and an outer surface 68 of the first end portion 24 and a second linear boundary 70 between the inner surface 62 of the first end portion 24 and the outer sidewall 60 of the ring 20. A distance $D_1$ between a central longitudinal axis A-A and the indentations 22 in the first end portion 24 of the shell 16 is greater than a distance $D_2$ between the central longitudinal axis A-A and the inner sidewall 56 of the ring 20. The distance $D_1$ between the central longitudinal axis A-A and the indentations 22 in the first end portion 24 of the shell 16 is less than a distance $D_3$ between the central longitudinal axis A-A and the outer sidewall 60 of the ring 20.

In an exemplary embodiment, the cartridge case 12 is a bi-metallic cartridge case. For example, the shell 16 may be formed of a first material and the reinforcing cap 18 may be formed of a second material that is different than the first metallic material. The ring 20 may be a third material that is different from at least one of the first material of the shell 16 and/or the second material of the reinforcing cap 18. In the context of this disclosure, one material is considered different from another material when they have different material compositions, and/or different physical properties, and/or different mechanical properties. For example, while 302 stainless steel and 304 stainless steel are both classified as 300 series austenitic stainless steel, they would be considered different materials in the context of this disclosure.

In an exemplary embodiment, the first material is a metallic material selected from iron alloy including carbon steel, alloy steel, tool steel or stainless steel, brass, aluminum, aluminum alloy, nickel, or nickel alloy, and preferably, stainless steel. In an exemplary embodiment, the second material is a metallic material selected from iron alloy including carbon steel, alloy steel, tool steel or stainless steel, brass, aluminum, aluminum alloy, titanium, titanium alloy, magnesium, magnesium or and preferably aluminum alloy. In an exemplary embodiment, the third material is a metallic material selected from aluminum, aluminum alloys, or iron alloys include carbon steel, alloy steel, tool steel or stainless steel.

Figure 6:
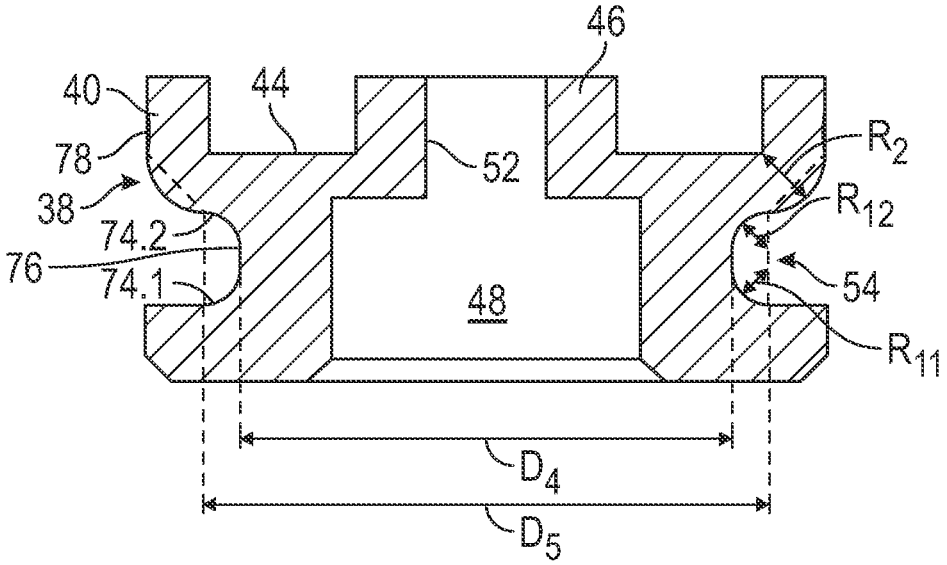
FIG. 6 is a detail showing the reinforcing cap.

With reference now to FIG. 6, an annular extraction groove 54 is formed in the base 38 to reduce the mass of the reinforcing cap 18. In an exemplary embodiment, the annular extraction groove 54 has a reduced diameter $D_4$ relative to the diameter $D_5$ of a legacy brass case (as shown in broken lines in FIG. 6). In addition, the extraction groove 54 includes interior radiused corners defined by radii $R_{11}$, $R_{12}$ extending between inner faces 74.1, 74.2 and to an inner wall 76 of the extraction groove 54. The radiused extraction groove 54 also includes an exterior radiused corner defined by a radius $R_2$ extending between the inner face 74.2 and a shoulder 78 of the base 38 adjacent the sidewall 40.

As illustrated, the shell 16, and in particular the cylindrical body 32 has a substantially constant wall thickness. Advantageously having the cylindrical body 32 with a substantially constant wall thickness allows the shell 16 of the cartridge case 12 to have an enlarged internal volume 34 as compared to the internal volume of conventional brass cartridge cases that are formed by a deep drawing process or the like and therefore, can hold an increase volume of the propellant.

The cartridge 10 includes the cartridge case 12, the propellant (shown as granules within the internal volume 34 in FIG. 2), the projectile 14, and a primer 72. The projectile 14 is disposed in the shell mouth 30. The propellant is ignitable to propel the projectile 14 from the shell mouth 30 in a forward direction (indicated by single headed arrow F). The primer 72 is disposed in the primer pocket 48 and is operable for igniting the propellant through the bore 52.

While at least one exemplary embodiment has been presented in the foregoing detailed description of the disclosure, it should be appreciated that a vast number of variations exist. It should also be appreciated that the exemplary embodiment or exemplary embodiments are only examples, and are not intended to limit the scope, applicability, or configuration of the disclosure in any way. Rather, the foregoing detailed description will provide those skilled in the art with a convenient road map for implementing an exemplary embodiment of the disclosure. It being understood that various changes may be made in the function and arrangement of elements described in an exemplary embodiment without departing from the scope of the disclosure as set forth in the appended claims.

What is claimed is:

1. A cartridge case for chambering in a weapon system, the cartridge case comprising:

a shell configured to contain a propellant in an internal volume thereof, the shell having a first end portion terminating at a first edge, a second end portion opposite the first end portion that is configured to receive a projectile and a cylindrical body extending from the first end portion to the second end portion;

a reinforcing cap disposed over the first end portion of the shell, the reinforcing cap having a base, a sidewall extending from the base and surrounding an outer surface of the first end portion such that the first edge of the shell abuts an inner face of the base, a projection extending from the inner face into the internal volume, an annular extraction groove formed in an outer surface of the base, and a primer pocket formed in an outer face of the base, wherein a bore extends from the primer pocket through the projection into the internal volume;

a ring pressed against the inner face of the base such that an inner sidewall of the ring sealably engages an outer surface of the projection and an outer sidewall of the ring sealably engages an inner surface of the first end portion, whereby an air-tight seal is formed between the projection, the inner face, the ring, the first end portion of the shell; and a plurality of indentations formed in the sidewall of the reinforcing cap, each of the indentation forming a protrusion in the sidewall and the first end portion of the shell for interlocking the reinforcing cap to the shell and retaining the ring against the inner face of the base.

2. The cartridge case of claim 1, wherein the shell comprises a first metallic material and the reinforcing cap comprises a second metallic material which is different than the first metallic material.

3. The cartridge case of claim 2, wherein the first metallic material is selected from the group consisting of iron alloy, brass, aluminum, aluminum alloys, nickel, or nickel alloys.

4. The cartridge case of claim 3, wherein the first metallic material is alloy steel or stainless steel.

5. The cartridge case of claim 2, wherein the second metallic material is selected from the group consisting of iron alloy, brass, aluminum, aluminum alloys, titanium, titanium alloys, magnesium, magnesium alloys.

6. The cartridge case of claim 5, wherein the second metallic material is alloy steel or stainless steel.

7. The cartridge case of claim 1, wherein at least one of the shell and the reinforcing cap comprises a first metallic material and the ring comprises a second material that is different from the first metallic materials.

8. The cartridge of claim 7, wherein the shell comprises the first metallic material and the reinforcing cap comprises a third metallic material that is different from the first metallic material.

9. The cartridge case of claim 1, wherein the shell has a substantially constant wall thickness.

10. The cartridge case of claim 1, wherein the protrusion in the first end portion at least partially interferes with the ring.

11. The cartridge case of claim 1, wherein each of the plurality of indentations comprises a dimple.

12. The cartridge case of claim 11, wherein each dimple comprises a partial spherical volume or a spherical skullcap.

13. The cartridge case of claim 1, wherein the plurality of indentations are evenly spaced around a perimeter of the sidewall.

14. The cartridge case of claim 1, wherein a cross section going through the plurality of indentations defines a non-circular boundary between the shell and the reinforcing cap.

15. The cartridge case of claim 1, wherein the shell further comprises a first linear boundary between the sidewall of the reinforcing cap and the outer surface of the first end portion and a second linear boundary between the inner surface of the first end portion and the outer sidewall of the ring.

16. The cartridge case of claim 1, wherein a first distance between a central longitudinal axis and the protrusion in the first end portion of the shell is greater than a second distance between the central longitudinal axis and the inner sidewall of the ring.

17. The cartridge case of claim 1, wherein a first distance between a central longitudinal axis and the protrusion in the first end portion of the shell is less than a second distance between the central longitudinal axis and the outer sidewall of the ring.

18. The cartridge case of claim 1, wherein the annular extraction groove has a first diameter that is less than a second diameter of an extraction groove formed in an equivalent brass cartridge case.

19. The cartridge case of claim 18, wherein the annular extraction groove comprises a first inner face, a second inner face and an inner wall connecting the first and second inner faces, and wherein an interior radiused corner extends between the inner wall and at least one of the first inner face and the second inner face.

20. The cartridge case of claim 18, wherein the annular extraction groove comprises a first inner face, a second inner face and an inner wall connecting the first and second inner faces, and wherein a first interior radiused corner extends between the inner wall and the first inner face and a second interior radiused corner extends between the inner wall and the second inner face.

21. The cartridge case of claim 18, wherein the annular extraction groove comprises an inner face, and a first exterior radiused corner extends between the inner face and a shoulder of the base adjacent to the sidewall.

22. A cartridge adapted to be chambered in a weapon system comprising:

a shell containing a propellant in an internal volume thereof, the shell having a first end portion terminating at a first edge, a second end portion opposite the first end portion receiving a projectile and a cylindrical body extending from the first end portion to the second end portion, wherein the propellant is ignitable to generate a combustion gas for propelling the projectile from the shell;

a reinforcing cap disposed over the first end portion of the shell, the reinforcing cap having a base, a sidewall extending from the base and surrounding an outer surface of the first end portion such that the first edge of the shell abuts an inner face of the base, a projection extending from the inner face into the internal volume, a primer pocket formed in an outer face of the base, wherein a bore extends from the primer pocket through the projection into the internal volume, and a primer disposed in the primer pocket and operable to ignite the propellant through the bore;

a ring pressed against the inner face of the base such that an inner sidewall of the ring sealably engages an outer surface of the projection and an outer sidewall of the ring sealably engages an inner surface of the first end portion, whereby an air-tight seal is formed between the projection, the inner face, the ring, the first end portion of the shell; and a plurality of indentations formed in the sidewall of the reinforcing cap, each of the indentation forming a protrusion in the sidewall and the first end portion of the shell for interlocking the reinforcing cap to the shell and retaining the ring against the inner face of the base.

23. The cartridge of claim 21, wherein each of the plurality of indentations comprises a dimple.

24. The cartridge of claim 22, wherein each dimple comprises a partial spherical volume or a spherical skullcap.

25. The cartridge of claim 22, wherein the plurality of indentations are evenly spaced around a perimeter of the sidewall.

* * * * *